US006315830B1

(12) United States Patent
Nakagawa et al.

(10) Patent No.: US 6,315,830 B1
(45) Date of Patent: Nov. 13, 2001

(54) MOLTEN METAL PLATING APPARATUS

(75) Inventors: Mitsuo Nakagawa, Mito; Yukio Saito, Hitachi; Junji Sakai, Minori-machi; Osamu Shitamura, Hitachinaka; Yasutsugu Yoshimura; Yoshio Takakura, both of Hitachi; Hironori Shimogama, Tokai-mura; Takehisa Kimura, Hitachinaka, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/309,513

(22) Filed: May 11, 1999

(30) Foreign Application Priority Data

May 11, 1998 (JP) ..... 10-127668

(51) Int. Cl.[7] ..... B05C 3/00

(52) U.S. Cl. ..... 118/423; 428/641; 428/681; 428/937

(58) Field of Search ..... 118/419, 423; 428/610, 641, 681, 941, 472.2, 937; 148/279; 427/452, 456

(56) References Cited

U.S. PATENT DOCUMENTS

| | | | |
|---|---|---|---|
| 5,137,375 | | 8/1992 | Murakami et al. . |
| 5,736,198 | * | 4/1998 | Yasutomi et al. . |

FOREIGN PATENT DOCUMENTS

| | | |
|---|---|---|
| 61-37955 | 2/1986 | (JP) . |
| 62-297454 | 12/1987 | (JP) . |
| 4-124254 | 4/1992 | (JP) . |
| 5-44002 | 2/1993 | (JP) . |

* cited by examiner

*Primary Examiner*—Brenda A. Lamb
(74) *Attorney, Agent, or Firm*—Crowell & Moring LLP

(57) ABSTRACT

In a molten metal plating apparatus all surfaces of a sinking roller and a supporting roller to be in contact with a molten metal are coated with iron silicide films. A bearing comprises a holder made of a heat resistant steel and lined with a carbon-carbon fiber complex material. A surface of the holder is coated with an $Fe_3Si$ film similar to the sinking roller. There is an $Fe_3Si$ film on a surface of a shaft portion, and the $Fe_3Si$ is in contact with and slides on the carbon-carbon fiber complex material.

5 Claims, 6 Drawing Sheets

MOLTEN METAL PLATING APPARATUS

BACKGROUND OF THE INVENTION

This application claims the priority of Japanese patent document 10-127668, filed May 11, 1998, the disclosure of which is expressly incorporated by reference herein.

The present invention relates to a molten metal plating apparatus in which an object is plated by immersing it in a molten metal, and particularly to a molten metal plating apparatus composed of components having good corrosion resistance and wear resistance to the molten metal.

Metals such as casting iron, stainless steel, high chromium steel and the like having corrosion resistance have been used for components of a molten metal plating apparatus, which are disposed in a molten metal. However, sinking rollers, supporting rollers and the like which are made of these materials cannot be used for long periods of time because the molten metals are strongly corrosive. Further, when a roller bearing or the like is corroded or worn, a plated film cannot be formed uniformly because of occurrence of vibration in a steel plate, which sometimes deteriorates the plating quality.

When an iron component used in a molten metal is corroded by the molten metal, an impurity in the form of a chemical compound of iron and the molten metal (called "dross") is formed in the molten metal. This not only degrades the plating film quality, but also shortens the lifetime of the molten metal itself. For these reasons, the rollers in a molten metal plating apparatus must be exchanged frequently, and the productivity of plated products is poor due to interruption of the operation for exchange of the roller.

In order to solve these problems, one known technique is to cover the components used in the molten metal with a cermet or a ceramic which is resistant to corrosion by the molten metal. Alternatively, the whole component used in the molten metal can be made of the cermet or the ceramic material. For example, Japanese Patent Application Laid-Open No. 61-37955 discloses a method of manufacturing a roller for use in a molten metal bath, having good corrosion resistance, heat resistance and wear resistance, by plasma spraying a ceramic onto a surface of a steel body. Japanese Patent Application Laid-Open No. 4-124254 discloses a bearing made entirely of a cermet or a ceramic, while Japanese Patent Application Laid-Open No. 5-44002 discloses a shaft of a roller made of cermet and a bearing totally made of a ceramic.

However, in known technology for surface treatment by the plasma spray method, pin holes are formed in the melt-sprayed film, and the molten metal can penetrate through the pin holes to corrode the body material, therefore, the melt-sprayed film is easily peeled off from the body material, and accordingly the reliability is low. On the other hand, since the component which is to be placed in the molten metal is generally quite large , it is technically and economically difficult to make the whole component using a cermet or a ceramic.

SUMMARY OF THE INVENTION

An object of the present invention is to provide a molten metal plating apparatus which can be operated for a long time, has good productivity of plated products, and can perform plating with good quality.

This and other objects and advantages are achieved by the molten metal plating apparatus according to the invention, which comprises a component made of iron having an iron silicide surface film (preferably $Fe_3Si$, or FeSi). The inventors have studied the corrosion resistance of various kinds of materials in a molten Zn-Al alloy, and have found that iron silicides have particularly good corrosion resistance.

As the iron suicides, there are $Fe_3Si$, $Fe_5Si_3$, FeSi, $FeSi_2$ and so on. An $Fe_3Si$ film can be formed through silicon penetration methods by which silicon is penetrated into a surface of a steel plate. As an example of silicon penetration methods, a steel member and silicon powder or silicon carbide powder are placed in a container and heated to a temperature of 930 to 1000° C. while chlorine gas is introduced (Metal Progress, 33 (1938) 367). In another method, a steel member is heated at 1200° C. for approximately 20 minutes in a flow of a mixed gas of 10% $SiCl_4$ +90% $N_2$ (Journal of Metallurgical Association of Japan, 26 (1962) 157). Finally, a steel member can be immersed in a molten Mg-Si alloy bath, and heated to 800 to 900° C. for several minutes (Iron and Steel, 83 (1997) 25).

Since an iron silicide film made of $Fe_5Si_3$, FeSi or $FeSi_2$ cannot be formed by silicon penetration, it is formed instead by a plasma spray method. However, when the iron silicides $Fe_5Si_3$ and $FeSi_2$ are used in the form of powder, they decompose at temperatures of 1193° C. and 1204° C., respectively, to produce Si. Therefore, $Fe_5Si_3$ and $FeSi_2$ in powder form are not suitable for use as raw materials for forming the iron silicide film. On the other hand, since FeSi powder has a melting point of 1410° C. and is unstable, it is preferable to form the iron silicide film by forming an FeSi spray film through a plasma spray method, using FeSi powder.

In the present invention, the $Fe_3Si$ film is formed by the Si penetration method, using an Mg-Si alloy bath, and the FeSi film is formed through the plasma spray method using FeSi powder as the raw material. By these methods, a closed compact film of iron silicide can be comparatively easily formed, and the formed iron silicide film has good adhesive property to the body material of iron. Therefore, since components made of iron and having an iron silicide surface film have a long lifetime without being corroded, even in a molten metal, molten metal plating apparatus employing such components can be operated for a long time and accordingly the productivity of the plated products can be improved.

Further, an intermediate film made of iron, silicon and cobalt, for example, an FeSi-12Co film may be interposed between the iron body and the iron silicide film. By interposing the intermediate film made of iron, silicon and cobalt between the iron body and the iron silicide film, it is possible to prevent the iron silicide film from being peeled off from the iron body, even if a thermal shock is applied to it.

Another feature of the present invention is that an iron rotating body disposed in the molten metal has an iron silicide film on its surface. A molten metal plating apparatus which includes rotating bodies such as a sinking roller, a supporting roller and so on having an iron silicide film on their surfaces can be operated for a long time. Accordingly the productivity of the plated products can be improved because the sinking roller and the supporting roller exhibit good corrosion and wear resistance. In addition, since less dross is produced, the occurrence of plating defects can be reduced, the quality of the plating can be improved and the lifetime of the molten metal itself can be lengthened.

A further feature of the present invention is that a bearing for supporting a rotating shaft of the rotating body comprises a member made of carbon fiber which is brought in contact with the rotating shaft having an iron silicide film on its surface. In a molten metal plating apparatus which uses a component which combines a rotating shaft with an $Fe_3Si$ surface film on the iron body and a bearing made of a carbon fiber such as a carbon-carbon fiber complex material, vibration does not occur in a steel plate even if the apparatus is operated for a long time. Accordingly, the plating quality can be maintained for a long time since corrosion and wear of the rotating shaft are very small.

Other objects, advantages and novel features of the present invention will become apparent from the following detailed description of the invention when considered in conjunction with the accompanying drawings.

DESCRIPTION OF THE PREFERRED EMBODIMENTS

Figure 1:
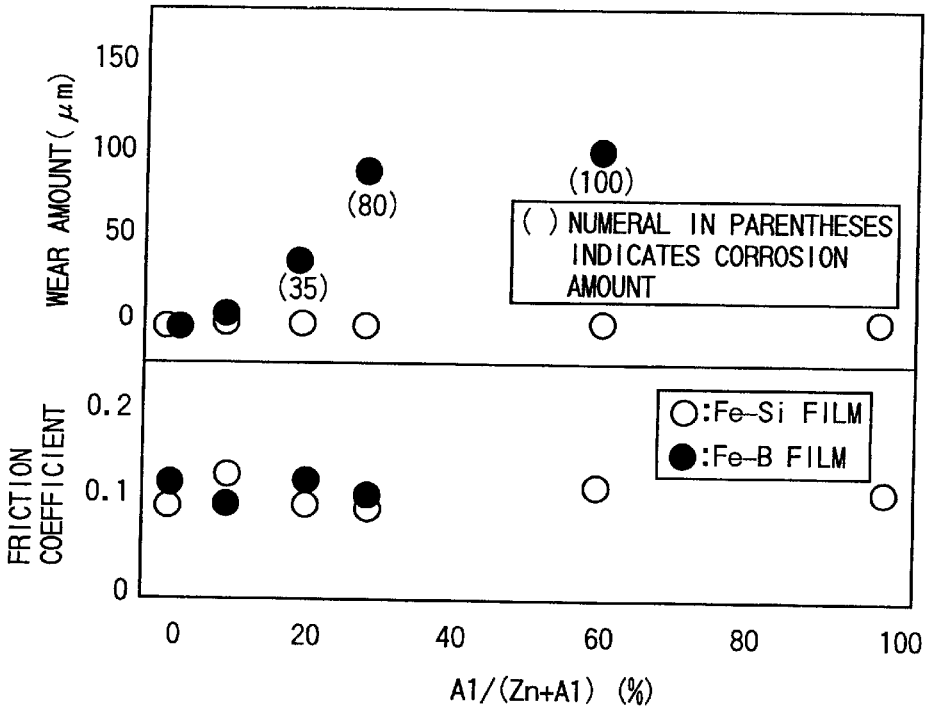
FIG. 1 is a graph showing the result of a friction and wear test simulating friction and wear between a roller and a steel plate.

Various tests were conducted with test specimens simulating iron components used in a molten metal plating apparatus in accordance with the present invention. The test specimen was a cylindrical body of 10 mm diameter and 20 mm length made of a carbon steel (S45C) and having an iron silicide film. Two kinds of test specimens were prepared, specimen A having an $Fe_3Si$ film and specimen B having an FeSi film.

With regard to specimen A, the $Fe_3Si$ film was formed on the surface of the carbon steel cylindrical body by the Si penetration method. In detail, an $Fe_3Si$ film having a thickness of approximately 100 $\mu$m was formed on the surface of the carbon steel cylindrical body by immersing the cylindrical body into an Mg-3% Si alloy bath (melting an Mg-3% Si alloy prepared by adding high purity silicon of 3% in weight ratio basis to magnesium for industrial use) at 850° C. for 15 minutes.

With regard to specimen B, the FeSi film was formed on the surface~of the carbon steel cylindrical body by the plasma spray method. In detail, the FeSi film having a thickness of approximately 250 $\mu$m was formed on the surface of the carbon steel cylindrical body by injecting FeSi powder having an average grain size of 5 $\mu$m into a plasma jet to spray the FeSi powder on the surface of the cylindrical body.

It was observed by an optical microscope that the iron silicide films of both of the specimens A and B were closely compacted. Tests of (1) corrosion resistance, (2) friction and wear resistance, and (3) thermal shock resistance were conducted.

(1) Corrosion test

The specimen A and the specimen B were placed in a zinc-aluminum alloy bath, and amounts of dissolved iron silicide were measured. The zinc-aluminum alloy bath was formed by melting an alloy of zinc and aluminum. By varying the composition ratio of zinc and aluminum, zinc-aluminum baths from 460° C. to 620° C. were prepared. The test specimens were kept in these zinc-aluminum baths and rotated at a peripheral speed of 20 m/minute for 100 hours. Thereafter, the specimens were cut and the FeSi group compound film was observed using an optical microscope.

For the purpose of comparison, test specimens of the cylindrical body were made of carbon steel having a surface film made of an Fe-C group chemical compound, an Fe-S group chemical compound, an Fe-P group chemical compound, iron nitride (main composition of $Fe_4N$ containing $Fe_{2-3}N$) and iron boride (FeB and $Fe_2B$), respectively, and were tested similarly to the specimens A and B.

The test results are shown in Table 1.

TABLE 1

| | Composition ratio Al/(Zn + Al) | | | | | | | |
|---|---|---|---|---|---|---|---|---|
| | 0 (100% Zn) | 0.2 | 0.5 | 1.0 | 10.0 | 30.0 | 55.0 | 100 (100% Al) |
| Temperature | 460 | 465 | 465 | 470 | 480 | 530 | 600 | 680 |
| Specimen A ($Fe_3Si$) | ⊙ | ⊙ | ⊙ | ⊙ | ⊙ | ⊙ | ⊙ | ○ |
| Specimen B (FeSi) | ⊙ | ⊙ | ⊙ | ⊙ | ⊙ | ⊙ | ⊙ | ⊙ |
| Fe—C group compound | ⊙ | ⊙ | ⊙ | ○ | X | X | X | X |
| Fe—S group compound | ⊙ | ⊙ | ○ | X | X | X | X | X |
| Fe—P group compound | X | X | X | X | X | X | X | X |
| Iron nitride ($Fe_4N$ & $Fe_{2-3}$ N) | Δ | Δ | Δ | X | X | X | X | X |
| Iron boride (FeB & $Fe_2B$) | ⊙ | ⊙ | ⊙ | ⊙ | ○ | Δ | X | X |

State of corrosion o: no corrosion, O: slightly corroded, Δ: largely corroded, X: surface film lost.

With regard to specimen A ($Fe_3Si$), corrosion of the $Fe_3Si$ film was not observed up to Al concentration of 60%, and slightly observed at Al concentration of 100%. With regard to specimen B (FeSi), corrosion of the FeSi film was not observed, even at an Al concentration of up to 100%.

With regard to the specimen having the Fe-C group chemical compound film, the film was lost in the alloy bath of zinc containing aluminum above 5%.

With regard to the specimen having the Fe-S group chemical compound film, the film was lost in the alloy bath containing aluminum above 1%, and largely corroded even in the alloy bath containing aluminum blow 0.5%

With regard to the specimen having the Fe-P group chemical compound film, corrosion occurred even in pure zinc, and the film was lost regardless of the concentration of aluminum.

The specimen having the iron nitride film (main composition of $Fe_4N$) was corroded in any bath.

With regard to the specimen having the iron boride film (FeB and $Fe_2B$), corrosion was not observed up to aluminum concentration of 1%; however, slight corrosion was observed at aluminum concentration of 10%, and the specimen was corroded above 55%.

The above test results confirm that the iron silicide formed on the surface of the carbon steel body was good in corrosion resistance, and stable in the molten metal of aluminum, even at concentrations above 55%.

In addition, the iron silicide FeSi film formed through the plasma spray method was not peeled off.

With regard to the other ceramic film ($Al_2O_3$, $ZrO_2$, TiC, WC-12Co, $TiB_2$ and so on) formed on the surface of a carbon steel body by a plasma spray method, the film itself is not generally corroded in the Zn-55% Al molten metal, but is peeled off from the body. The reason is considered that there exist pin holes in the other ceramic film formed through the plasma spray method, so that the molten metal passes through the pin holes and reaches the body, corroding it. On the other hand, the reason why the iron silicide FeSi film formed through the plasma spray method is not peeled off is that the diameter of the pin hole formed during the film forming is very small or no pin holes are formed because the melting point of FeSi is as low as 1410° C. which is very low compared to those of Al203, $ZrO_2$, TiC, WC-12Co, TiB2 200° F. to 3100° C.

Therefore, it can be said that the iron silicide FeSi film formed through the plasma spray method has high performance to coat the carbon steel body compared to the other ceramic film formed through a plasma spray method.

Next, a corrosion test was performed by varying the film thickness of the specimen A ($Fe_3Si$) and the specimen B (FeSi).

With regard to specimen A, specimens having average film thickness of 4, 8, 20, 40, 70 $\mu$m were prepared by immersing the carbon steel body into a Mg-3% Si alloy bath at 850° C. for 0.5, 1, 3, 5, 10 minutes. With regard to specimen B, specimens having average film thickness of 20, 45, 60, 95, 135 $\mu$m were prepared by varying scanning speed of the plasma spray using FeSi powder having an average grain size of 5 $\mu$m.

The corrosion test was performed using a Zn-55% Al bath at a temperature of 600° C. with no rotation, and an immersion time of 100 hours. After the corrosion test, the specimens were extracted from the bath, and immersed into a HCl aqueous solution until generation of bubbles ($H_2$) disappeared; thereafter, the surface was observed by visual inspection and by an optical microscope to detect the presence or absence of corrosion.

With regard to specimen A, defects caused by corrosion were found in the specimens having average film thickness of 4 and 8 $\mu$m, but not in the specimens having average film thickness above 20 $\mu$m. With regard to specimen B, defects caused by corrosion were found in the specimen having an average film thickness of 20 $\mu$m, but not in the specimens having average film thickness above 45 $\mu$m.

The reason why there is a difference in corrosion resistance of the film thicknesses, as between the specimen A and the specimen B, is considered that since the film formed through the plasma spray method is rough compared to the film formed though the Si penetration method, the area of the film in contact with the zinc-aluminum alloy is greater, and consequently the film is easily corroded. From the above result, it is preferable that the thickness of the film is above 20 $\mu$m when the $Fe_3Si$ film is formed through the Si penetration method, and the thickness of the film is above 45 $\mu$m when the FeSi film is formed through the plasma spray method.

(2) Friction and wear tests

Initially, in order to study friction coefficients between a roller and a steel plate and wear amounts of the roller, a friction and wear test was conducted using the low carbon steel. The low carbon steel specimen simulates a steel plate to be plated.

The specimen A was fabricated by immersing a carbon steel body into a Mg-5% Si alloy bath at 800° C. for 1 hour. The specimen A had a comparatively porous surface film of approximately 150 $\mu$m, and a closely packed $Fe_3Si$ film between the porous film and the body. By analyzing the composition using X-ray diffraction technology, a small amount of silicon excessive $FeSi_2$ was found at a position near the surface, but the other portion of the film was $Fe_3Si$. The friction and wear test was conducted by putting the specimen A in contact with the low carbon steel specimen with a surface pressure of 5 MPa, rotating the specimen A at a rotating speed of 16 m/min, varying the composition ratio of the zinc-aluminum alloy bath, and continuously operating for 10 hours.

FIG. 1 shows the test result. For the purpose of comparison, a test result using a specimen having an FeB film of approximately 100 $\mu$m is also shown in FIG. 1.

The result for the specimen A ($Fe_3Si$) is shown by a mark O in FIG. 1. Neither corrosion nor wear were observed, and the friction coefficient was around 0.1 for all kinds of zinc-aluminum baths. This is a sufficiently low friction coefficient. Therefore, since a component having an $Fe_3Si$ film on its surface is excellent in corrosion resistance and in wear resistance, it can be said that the component having the $Fe_3Si$ surface film is suitable for the component used in the molten metal and also for the component in contact with a steel plate such as the sinking roller or the supporting roller.

On the other hand, the results for the specimen having the FeB film is shown by a mark • in FIG. 1. Wear was observed and corrosion occurred in the zinc-aluminum bath of aluminum concentration of 10%. When the aluminum concentration was further increased, wear caused by corrosion was substantially progressed. The FeB film was lost an aluminum concentration above 60%. Therefore, components having an FeB film are unsuitable for use in the molten metal.

Next, in order to study friction coefficients between a roller and a bearing and the amount of wear of the roller, a friction and wear test was conducted using the specimen A, the specimen B, and a specimen made of a carbon/carbon fiber. The carbon/carbon fiber specimen simulates a bearing for supporting shaft of the sinking roller or the supporting roller.

The specimen A has an $Fe_3Si$ surface film of approximately 180 $\mu$m formed by immersing the carbon steel body into an Mg-3%Si alloy bath at 850° C. for 20 hours. The specimen B has an FeSi surface film of approximately 100 $\mu$m formed through the plasma spray method. The carbon/ carbon fiber specimen is formed by hot-press forming a fiber cluster having a diameter of 80 to 120 μm composed of carbon fiber (5 to 7 μm) pre-impregnated with a matrix (pitch group carbon) composition on the surface and then sintered (in a vacuum, 2300° C.). The carbon/carbon fiber complex material has been used as a slide member because the carbon/carbon fiber complex material is highly corrosion resistant to the molten metal, and has a solid lubrication property.

The friction and wear test was conducted by putting the specimen A and the specimen B in contact with the low carbon steel specimen with a surface pressure of 5 MPa, rotating the specimens A and B at a rotating speed of 16 m/min in a Zn-55% Al alloy bath, and continuously operating for 10 hours.

Figure 2:
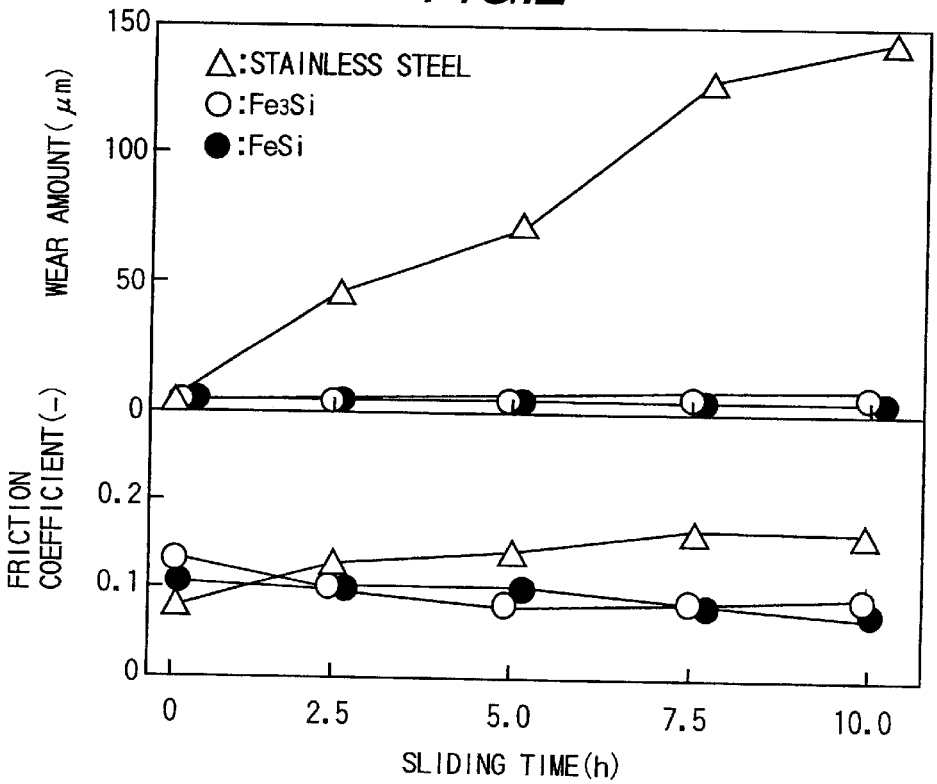
FIG. 2 is another graph showing the result of a friction and wear test simulating friction and wear between a roller and a bearing.

FIG. 2 shows the test result. For comparison, a test result using a specimen made of stainless steel 304 and the carbon/carbon fiber specimen is also shown in FIG. 2.

Both in the combination of the specimen A ($Fe_3Si$) and the carbon/carbon fiber specimen and in the combination of the specimen B (FeSi) and the carbon/carbon fiber specimen, the friction coefficient was nearly 0.1 and the wear amount was small up to 10 hours elapsed from starting of the test. Therefore, it is possible to construct a sliding portion having high corrosion resistance, high wear resistance and high reliability by forming the $Fe_3Si$ film on the surface of the shaft of the sinking roller or the supporting roller and combining with the carbon/carbon fiber bearing.

On the other hand, in the combination of the stainless steel specimen and the carbon/carbon fiber specimen, the friction coefficient was small, but the amount of wear to the stainless steel specimen was increased with elapsing time.

Further, since the iron silicide film was not peeled off from the body in both of the specimens A and B in the friction and wear test, it can be said that the adhesive property between the iron silicide film and the body is good.

(3) Thermal shock resistance test

A thermal shock resistance test was studied using a test member C with an iron silicide surface film formed on a carbon steel body, and a test member D with an iron silicide surface film formed on a carbon steel body through an FeSi-12Co film.

The test member C was made by forming an FeSi film having a thickness of approximately 200 μm on a cylindrical hollow body made of S45C type carbon steel and having an outer diameter of method. The test member D was by forming an FeSi-12Co intermediate film having a thickness of approximately 70 μm on the same body as that of the test member C through the plasma spray method, and then forming an FeSi film having a thickness of approximately 200 μm on the intermediate film.

These test members were immersed in a Zn-55~Al bath heated at 600° C. to apply a thermal shock to them, after which they were immersed in a HCl aqueous solution to remove attached Zn-Al, and then the surfaces were visually observed. Peeling occurred in an edge portion of the test member C. It was considered that it was caused by stress based on thermal expansion difference generated by the thermal shock. On the other hand, there was no peeling in the test member D.

Therefore, in order to improve thermal chock resistance, it is effective to place the FeSi-12Co intermediate film between the carbon steel body and the FeSi film.

(Embodiment 1)

Figure 3:
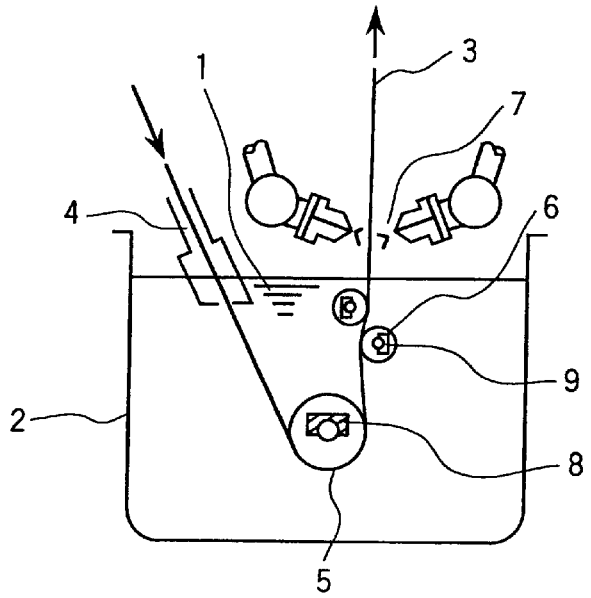
FIG. 3 is a view showing a first embodiment of a molten metal plating apparatus.

As shown in FIG. 3, a first embodiment of a molten metal plating apparatus in accordance with the present invention described below, comprises components having an iron silicide film on the surface of the carbon steel body.

A plating bath 2 is filled with a molten metal 1, and a snout 4 guides a strip of steel plate 3 to the plating bath 2. A sinking roller 5 which is arranged in the plating bath 2 changes the direction of the steel plate 3, and a supporting roller 6 is provided to suppress vibration of the steel plate 3. A gas wiping unit 7 removes excess molten metal from the surface of the steel plate 3 after it is extracted from the plating bath 2. In this embodiment, all the surfaces of the sinking roller 5 and the supporting roller 6 which are in contact with the molten metal 1 are coated with the iron silicide films. Shafts of the sinking roller 5 and the supporting roller 6 are supported by bearings 8 and 9 fixed in the plating bath 2, respectively. The diameter of the support roller 6 is nearly one-third that of the sinking roller 5.

The surface of the strip of steel plate 3 is first activated by being reduced externally, using hydrogen or the like. The strip is guided into the molten metal 1 in the plating bath through the snout 4. The moving direction of the steel plate 3 is changed by the sinking roller 5 and extracted from the plating bath 2 through the support roller 6, and the excessive molten metal 1 is removed by the gas wiping unit 7 to adjust the plating thickness, and then the steel plate is sent out as the plated steel plate. Supplying and winding of the steel plate 3 are interlocked so that a constant tensile force is applied to the steel plate 3. A speed of the supplying and winding is 10 to 200 m/min.

The sinking roller 5 and the supporting roller 6 used in the embodiment of the molten will be described in detail below.

Figure 4:
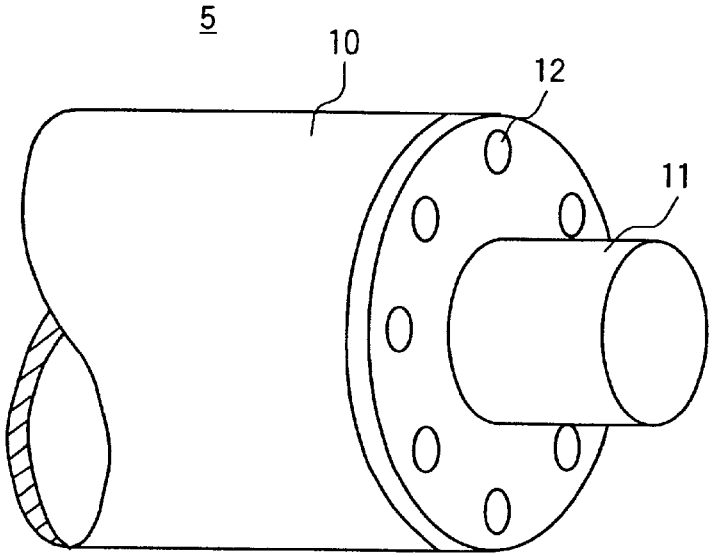
FIG. 4 is a view showing a sinking roller.

FIG. 4 shows the sinking roller 5, which is composed of a cylindrical body portion 10 and a shaft portion 11, both of which are made of S45C carbon steel. One end of the shaft portion 11 is formed in a flange shape, and coupled with the body portion 10 with bolts 12. Similarly, the supporting roller 6 is also composed of a cylindrical body portion and a shaft portion, both made of S45C carbon steel.

Figure 5:
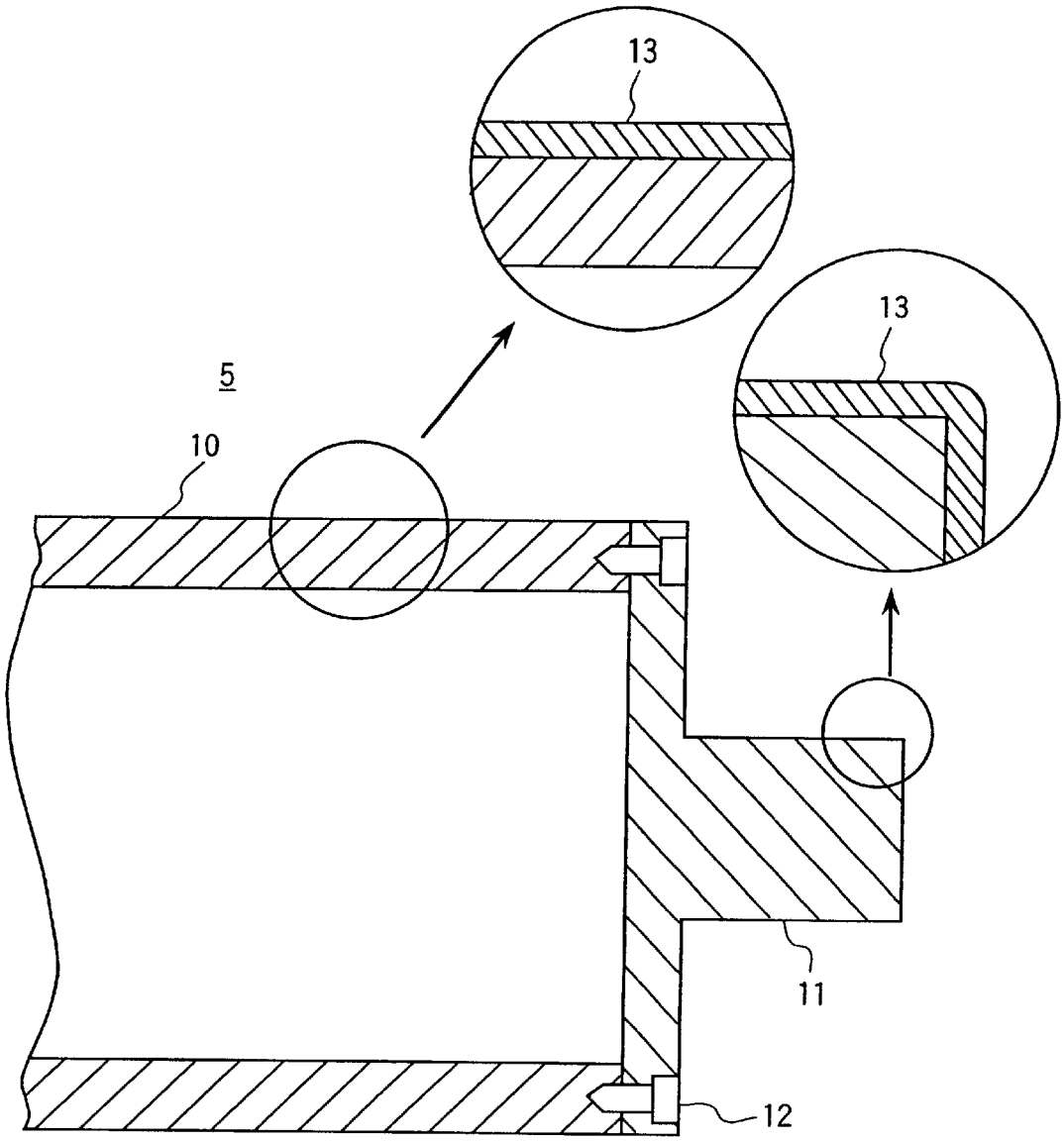
FIG. 5 is a view showing a cross section of the sinking roller.

FIG. 5 shows a cross section of the sinking roller 5, with an $Fe_3Si$ film 13 formed on the S45C carbon steel surface. A method of forming the $Fe_3Si$ film 13 on the sinking roller 5 will be described below.

Initially, as a pre-treatment, the S45C carbon steel was kept at a temperature of 900° C. for 10 hours and then slowly cooled in a furnace. The body portion 10 and the shaft portion 11 were formed by machining the pre-treated S45C carbon steel , and then the body portion 10 and the shaft portion 11 were assembled into the roller.

Next, the $Fe_3Si$ film 13 was formed on the surface of the roller by silicide treatment and the Si penetration method. In the silicide treatment, the roller was suspended in a stainless steel (SUS316) cylindrical case, and then a block of an Mg-3%Si alloy prepared by adding high purity silicon of 3% in weight ratio basis to magnesium for industrial use placed into the cylindrical case. The cylindrical case was then heated to 800° C. in an electric furnace of argon atmosphere to melt the Mg-5%Si alloy, and the roller was kept in the molten metal for 3 hours.

After the silicide treatment, the roller was extracted from the molten metal and transferred to an electric furnace, heated to 800° C., and cooled down to room temperature at a cooling speed of 30° C./h. An $Fe_3Si$ film 13 of 110 μm to 140 μm thickness was formed on the surface of the body portion 10 and the shaft portion 11 of the sinking roller 5 without crack or peeling. The supporting roller 6 was also fabricated in a similar manner.

The bearings 8 and 9 fixed to the plating bath support the shafts of the sinking roller 5 and the supporting roller 6, respectively.

Figure 6:
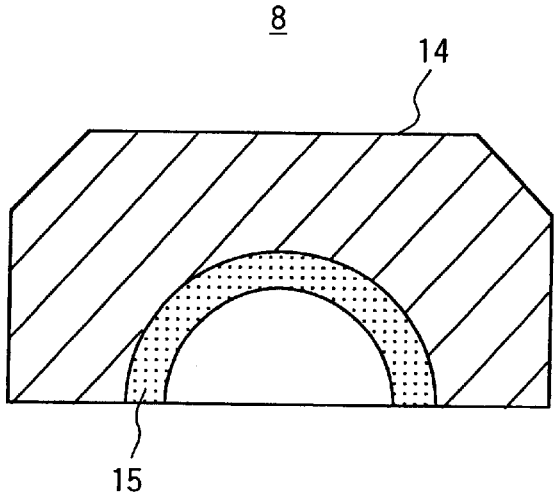
FIG. 6 is a view showing a bearing.
Figure 10:
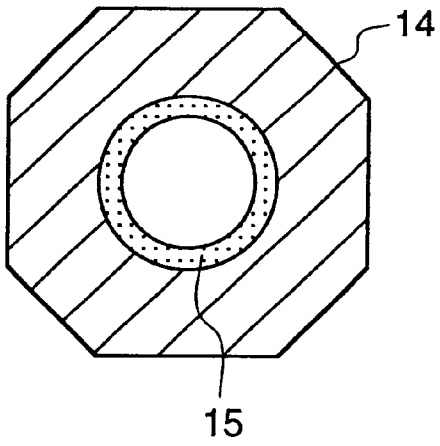
FIG. 10 is a view showing a further example of a bearing.

FIG. 6 shows the bearing 8. Since a tensile force of the steel plate 3 is applied to the sinking roller 5 from the down side, the bearing 8 of the sinking roller 5 is semi-spherical. The carbon/carbon fiber complex material 15 is lined on the inner surface of a holder 14 made of a heat resistant steel. The surface of the holder 14 is coated with the $Fe_3Si$ film 13 similarly to the sinking roller 5. The bearing 9 of the supporting roller 6 may be similar to the bearing 8 of the sinking roller 5, but a cylindrical bearing formed of a carbon/carbon fiber complex material 15 and the holder 14 as shown in FIG. 10 is acceptable.

Figure 7:
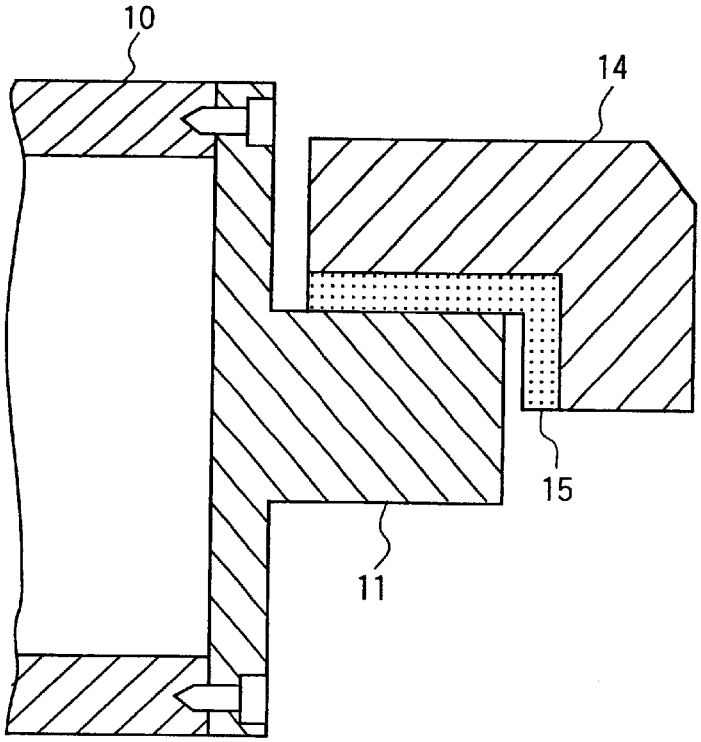
FIG. 7 is a view showing a cross section in an axial direction when the sinking roller and the bearing are combined.

FIG. 7 shows an axial cross section of the combined sinking roller 5 and bearing 8. The $Fe_3Si$ film 13 formed on the side and end surfaces of the shaft portion 11, is in contact with, and slides on, the carbon/carbon fiber complex material 15.

The sinking roller 5 and the bearing 8 were set in a molten metal plating apparatus having the bath 2 filled with a Zn-55% Al alloy at 600° C., and continuously used for 100 hours. No wear was observed in either the body portion 10 or the shaft portion 11 after such use, and the slide surface of the carbon/carbon fiber complex material 15 was smooth. Further, the body portion had no attached dross, and was in a good condition.

Therefore, since the sinking roller and the supporting roller have good corrosion and wear resistance, the molten metal plating apparatus in accordance with the present embodiment can be operated for a long time, and accordingly the productivity of the plated product can be improved. Further, since corrosion and wear in the shaft portions of the sinking roller and the supporting roller are very small, vibration does not occur in the steel plate, even if the apparatus is operated for a long time; accordingly good plating quality can be maintained for a long time. Furthermore, since production of dross is very small, plating defects can be reduced and the plating quality can be improved, and the lifetime of the molten metal itself can be lengthened.

Figure 8:
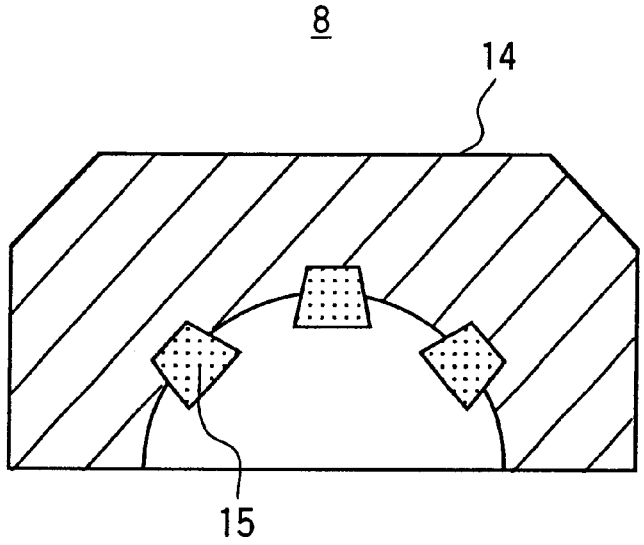
FIG. 8 is a view showing another example of a bearing.

Although the carbon/carbon fiber complex material 15 is lined inside surface of the holder 14 of the bearing 8, blocks of the carbon/carbon fiber complex material 15 may be embedded in the holder 14, as shown in FIG. 8.

Although in the above description, the sinking roller 5, the supporting roller 6 and the bearings 8, 9 are coated with the iron silicide films on the surfaces, the iron silicide films may be formed on the surfaces of the other components used in the molten metal plating apparatus in addition to the above mentioned components.

For example, by coating the surfaces of a guide roller, a nozzle portion of the gas wiping unit 7, the snout 4 in contact with the plated steel plate and the surfaces of a pipe, a valve and pump used for exchanging the molten metal with iron silicide, it is possible to prevent these components from being corroded by the molten metal.

However, since iron silicide is corroded by the molten metal in an oxygen of atmosphere, it is necessary to form a non-oxidizing atmosphere by avoiding atmospheric air. In regard to the snout 4, only the inside of the snout 4 (which is in a hydrogen atmosphere) may be coated with the iron silicide film.

According to the present embodiment of the zinc-aluminum alloy molten metal plating apparatus, since the components used in the molten metal such as the sinking roller 5, the supporting roller 6, the bearings 8 and 9 have sufficient corrosion resistance and wear resistance, the apparatus can be operated for a long time.

Further, although the total surface of the roller is in the present embodiment, it is possible (depending on the kind of molten metal) to use conventional material for the body portions of the sinking roller 5 and the supporting roller 6, and the iron silicide film may be formed only on the surface of the shaft portions 11 to which high surface pressure and sliding are applied.

(Embodiment 2)

A second embodiment of a molten metal plating apparatus in accordance with the present invention will be described below. The second embodiment differs from the first embodiment sinking roller and the supporting roller, but the other elements are the same. Each of the rollers in this embodiment have an FeSi-12Co intermediate film and an FeSi iron silicide film on the surface.

Figure 9:
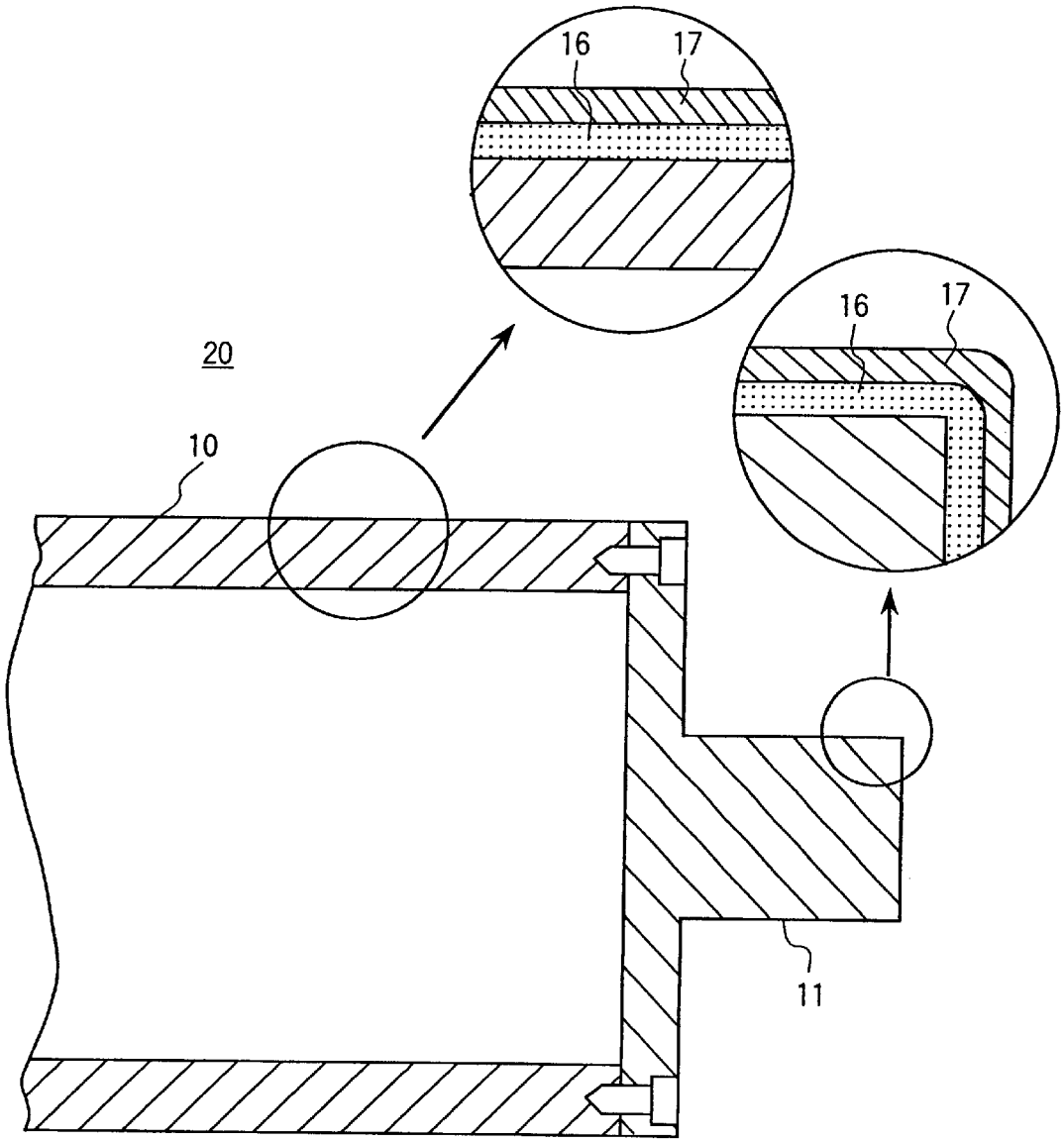
FIG. 9 is a view showing a cross section of a sinking roller.

FIG. 9 shows a cross section of the sinking roller 20. An FeSi-12Co film 16 having a thickness of approximately 70 $\mu$m is formed on the surfaces of a body portion 10 and a shaft portion 11 made of S45C carbon steel, and an FeSi film 17 having a thickness of approximately 200 $\mu$m is formed on the film 16.

A method of forming the FeSi-12Co film 16 and the FeSi film 17 on the sinking roller 20 will be described below. A roller fabricated through pre-treatment, machining and assembling similarly to the case of the sinking roller 5 is used.

Initially, the FeSi-12Co film 16 was formed on the surface of the roller by the plasma spray method. Thereafter, the FeSi film 17 was then formed on the FeSi-12Co film 16, also by the plasma spray method. No cracking or peeling was observed on the fabricated sinking roller 20. The supporting roller was also fabricated in a similar manner.

The molten metal plating apparatus in accordance with the present embodiment can attain the same effect as the molten metal plating apparatus described in the first embodiment. Since the sinking roller 20 and the supporting roller have good thermal shock resistance, the incidence of cracks and peeling can be prevented even if a rapid temperature change occurs in the molten metal during supplying or exchanging the molten metal; accordingly the reliability of the molten metal plating apparatus can be improved.

Although carbon steel is used as the material for the body of the components of the molten metal plating apparatus in the above, the invention is not limited to carbon steel and any material is acceptable if the iron silicide film may be formed on the material through the penetration method or the plasma spray method.

According to the present invention, the components made of steel having the iron silicide film on the surface are not corroded even in the molten metal, and are long in lifetime. Thus, molten metal plating apparatus employing such components can be operated for a long time and accordingly the productivity of the plated product can be improved. The iron silicide film is preferably formed of $Fe_3Si$ or FeSi.

Further, by providing an intermediate film made of iron, silicon and cobalt between the body of iron and the iron silicide film, it is possible to prevent the iron silicide film from being peeled off from the body of iron even if a thermal shock is applied to it.

In the molten metal plating apparatus which comprises rotating bodies such as a sinking roller and a supporting roller having the iron silicide films on the surfaces, since the sinking roller and the supporting roller are excellent in corrosion resistance and in wear resistance, the apparatus can be operated for a long time and accordingly the productivity of the plated product can be improved. Further, since production of dross is very small, plating defects can be reduced and the plating quality can be improved, and the lifetime of the molten metal itself can be lengthened.

Furthermore, in the molten metal plating apparatus in which a combined portion of a rotating shaft and a bearing is formed by combination of the rotating shaft having the $Fe_3Si$ film on the surface of the body of iron and the bearing made of a carbon fiber such as a carbon/carbon fiber complex material, since corrosion and wear in the rotating shaft are very small, vibration does not occur in the steel plate even if the apparatus is operated for a long time and accordingly the plating quality can be maintained for a long time in a good state.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An apparatus for applying a metal plating to a solid metal item by bringing said item into contact with a molten metal, said apparatus comprising:

means for immersing said solid metal item into said molten metal;

wherein said means comprises a component made of iron and having an outermost surface film of iron silicide.

2. The apparatus according to claim 1, wherein said iron silicide film comprises a material selected from the group consisting of $Fe_3Si$ and FeSi.

3. The apparatus according to claim 1, wherein said component having an iron silicide surface film comprises a rotating body made of iron for moving said solid metal item in the molten metal, said rotating body being rotated in contact with said molten metal.

4. The apparatus according to claim 3, wherein said means further comprises a bearing for supporting a rotating shaft of said rotating body to fix a position of said rotating body;

said bearing comprises a member made of carbon fiber, said member being brought in contact with said rotating shaft; and said rotating shaft has an iron silicide surface film.

5. An apparatus for applying a metal plating to a solid metal item by bringing said item into contact with a molten metal, said apparatus comprising:

means for immersing said solid metal item into said molten metal;

wherein said means comprises a component made of iron and having an iron silicide surface film; and wherein an intermediate film made of iron, silicon and cobalt is interposed between said iron component and said iron silicide film.

* * * * *